US011713761B2

(12) United States Patent
Huang et al.

(10) Patent No.: US 11,713,761 B2
(45) Date of Patent: Aug. 1, 2023

(54) SCREW COMPRESSOR WITH A SHUNT-ENHANCED DECOMPRESSION AND PULSATION TRAP (SEDAPT)

(71) Applicants: Paul Xiubao Huang, Fayetteville, GA (US); Sean William Yonkers, Georgetown, GA (US)

(72) Inventors: Paul Xiubao Huang, Fayetteville, GA (US); Sean William Yonkers, Georgetown, GA (US)

( * ) Notice: Subject to any disclaimer, the term of this patent is extended or adjusted under 35 U.S.C. 154(b) by 0 days.

(21) Appl. No.: 17/485,432

(22) Filed: Sep. 26, 2021

(65) Prior Publication Data

US 2023/0097255 A1 Mar. 30, 2023

(51) Int. Cl.

| | |
|---|---|
| ***F04C 29/00*** | (2006.01) |
| ***F04C 29/06*** | (2006.01) |
| ***F04C 18/16*** | (2006.01) |
| ***F04B 11/00*** | (2006.01) |
| ***F04B 39/00*** | (2006.01) |

(52) U.S. Cl.

CPC ..... *F04C 29/0035* (2013.01); *F04C 18/16* (2013.01); *F04C 29/068* (2013.01); *F04B 11/00* (2013.01); *F04B 39/0055* (2013.01); *F04C 2270/185* (2013.01); *F04C 2270/585* (2013.01)

(58) Field of Classification Search

CPC .... F04C 29/0035; F04C 18/16; F04C 29/068; F04C 2270/185; F04C 2270/585; F04B 11/00; F04B 39/0055

See application file for complete search history.

(56) References Cited

U.S. PATENT DOCUMENTS 7,143,697 B2 * 12/2006 Mace ..... F42B 5/02 102/430
9,151,292 B2 * 10/2015 Huang ..... F04C 29/068
(Continued)

OTHER PUBLICATIONS

SEDAPT paper entitled A Novel Screw Compressor with a Shunt Enhanced Decompression and Pulsation Trap (SEDAPT) for presentation at 13 International Conference on Sep. 11-13, 2023, City University, London (Year: 2023), by Paul Xiubao Huang.*
(Continued)

*Primary Examiner* — Dominick L Plakkoottam
*Assistant Examiner* — Paul W Thiede

(57) ABSTRACT

A shunt-enhanced decompression and pulsation trap (SEDAPT) for a screw compressor assists internal compression (IC), reduces gas pulsation and NVH (Noise, Vibration & Harshness), and improves off-design efficiency, without using a slide valve and/or a serial pulsation dampener. The SEDAPT includes an inner casing, e.g., an integral part of the compressor chamber, and an outer casing, e.g., surrounding part of the inner casing near the compressor discharge port, forming at least one diffusing chamber with an outflow orifice or nozzle equipped with an ODV (one-direction valve) at the outflow exit and a feedback region that provides a feedback outflow loop between the compressor chamber and the compressor discharge port. The SEDAPT automatically bleeds or compensates cavity pressure to meet different outlet pressures, eliminates or reduces energy waste, gas pulsations and NVH associated with any over-compression and under-compression before the discharge port opens.

7 Claims, 20 Drawing Sheets

(56) References Cited

U.S. PATENT DOCUMENTS

| | | | | |
|---|---|---|---|---|
| 2009/0142212 | A1* | 6/2009 | Huang | F04C 29/04 418/206.1 |
| 2012/0171069 | A1* | 7/2012 | Huang | F04C 2/16 428/131 |
| 2015/0361982 | A1* | 12/2015 | Huang | F04C 18/126 418/157 |
| 2020/0109713 | A1* | 4/2020 | Huang | F04C 29/063 |
| 2021/0179411 | A1* | 6/2021 | Dahan | B67D 1/1202 |

OTHER PUBLICATIONS

SEDAPT vs Bicycle Pump drawings presented at Phone Interview held on Jan. 6, 2023 (Year: 2023).*

* cited by examiner

SCREW COMPRESSOR WITH A SHUNT-ENHANCED DECOMPRESSION AND PULSATION TRAP (SEDAPT)

CROSS-REFERENCE TO RELATED APPLICATIONS

This application is a continuation-in-part of U.S. Non-Provisional patent application Ser. No. 17/014,357, filed Sep. 8, 2020, which is hereby incorporated herein by reference in its entirety for all purposes.

TECHNICAL FIELD

The present invention relates generally to the field of rotary gas compressors, and more particularly relates to rotary screw compressors having twin meshing helical-shaped multi-lobe rotors.

BACKGROUND

A rotary screw compressor uses two helical screws, known as rotors, to compress the gas. In a dry running rotary screw compressor, a pair of timing gears ensures that the male and female rotors each maintain precise positions and clearances. In an oil-flooded rotary screw compressor, injected lubricating oil film fills the space between the rotors, both providing a hydraulic seal and transferring mechanical energy between the driving and driven rotor. Gas enters at a suction port of the compressor and gets trapped between moving threads and compressor casing forming a series of moving cavities as the screws rotate. Then the volumes of the moving cavities decrease and the gas is compressed. The gas exits at the end of the screw compressor through a discharge port normally connected to a discharge dampener to finish the cycle. It is essentially a positive displacement mechanism but using rotary screw motion instead of reciprocating piston motion so that displacement speed can be much higher. The result is a more continuous stream of flow with a more compact size when comparing with the traditional reciprocating types.

However, it has long been observed that screw compressors inherently generate gas pulsations with pocket passing frequency at discharge, and the pulsation amplitudes are especially significant when operating under high pressure and/or at off-design conditions of either an under-compression (UC) or an over-compression (OC). An under-compression, as shown in FIG. 1*c*, happens when the gas pressure at the compressor outlet (discharge port) is greater than the gas pressure inside the compressor cavity just before the discharge port opening. This results in an "explosive" inflow of the gas from the outlet into the cavity as illustrated in FIG. 1*a*. On the other hand, an over-compression, as shown in FIG. 1*d*, takes place when the pressure at the compressor outlet is smaller than the pressure inside the compressor cavity just before the discharge port opening, causing an "explosive" outflow of the gas from the cavity into the outlet illustrated in FIG. 1*b*. All fixed pressure ratio positive displacement compressors suffer from the under-compression and/or over-compression due to the impossibility of matching one fixed design pressure ratio to varying system back pressures. Typical applications with variable pressure ratios include various refrigeration and heat pump systems, and vacuum pump and fuel cell booster. For example, when ambient temperature rises or falls, the pressure ratios used in the refrigeration and heat pump systems have to change accordingly. Often, the range of the pressure ratio variation is significant and the effects of OC and UC are further enhanced by the elevated pressures that refrigerant needs to operate. Another example of requiring a wide range of operating pressure ratios is the vacuum pump that is used to pull down vacuum level in a system (for example, to pump air from a vessel to atmosphere), continuously increasing the pressure ratio as the vacuum level gets higher and higher. An emerging application for variable pressure compressors is the hydrogen fuel cells used for Electric Vehicles which require oxygen from air to make power. The power density and efficiency of fuel cells are found to be greatly boosted by supercharging the air supply, analogous to supercharging a gasoline car. For these applications, the UC and OC induced energy losses and gas pulsations are significant, especially the later one, if left undamped, can potentially damage downstream pipelines, equipment and induce severe vibrations and noise within the compressor system.

To address the after-effects of the pressure ratio mismatch problem, a large pulsation dampener known in the trade as reactive and/or absorptive type as shown in FIG. 2*a*, is usually required at the discharge side of a screw compressor to dampen the gas pulsations and NVH (Noise, Vibration & Harshness). It is generally very effective in gas pulsation control with a reduction of 20-40 dB but is large in size and causes other problems such as inducing more noises due to additional vibrating surfaces, or sometimes causes dampener structure fatigue failures that could result in catastrophic damages to downstream components and equipment. At the same time, discharge dampeners used today create high pressure losses as illustrated in FIG. 2*b* that contribute to poor compressor overall efficiency. For this reason, screw compressors are often cited unfavorably with high gas pulsations, high NVH and low off-design efficiency (as shown in FIG. 2*c*) and bulky size when compared with dynamic types like centrifugal compressors.

To overcome the mismatch problem at source, a concept called slide valve has been explored widely since 1960s as demonstrated in FIGS. 3*a*-3*b*. For example, the slide valve concepts are disclosed in U.S. Pat. No. 3,088,659 to H. R. Nilsson et al and entitled "Means for Regulating Helical Rotary Piston Engine", or in U.S. Pat. No. 3,936,239 to David. N. Shaw and entitled "Under-compression and Over-compression Free Helical Screw Rotary Compressor". The idea, often called variable Vi scheme, is to use a slide valve to mechanically vary the internal volume ratio hence compression ratio of the compressor to meet different operating pressure requirements, and to eliminate the under-compression and/or over-compression that are the source of discharge gas pulsations and energy losses. However, these systems typically are very complicated structurally with high cost and low reliability. Moreover, they do not work for widely used dry screw applications where oil is not available to lubricate the sliding valve parts.

In an effort to achieve the same goal of the slide valve variable Vi idea but without its complexity and limitation of applications, a Shunt Pulsation Trap (SPT) technology as shown in FIGS. 4*a*-4*b* was disclosed for example in several co-owned patents (U.S. Pat. Nos. 9,140,260; 9,155,292; 9,140,261; 9,243,557; 9,555,342; and 9,732,754). The idea is to use fluidly gas to compensate the variable load conditions rather than moving the solidly mechanical parts that are sensitive to friction, fatigue failure and response frequency. SPT is capable of achieving the same goal of the slide valve by an automatic feedback flow loop both to communicate between the compressor cavity and outlet (discharge port) and to compensate the cavity compression by adding or subtracting gases (just like inflating or deflating a basketball) in such a way as to eliminate the under-compression or over-compression when discharge port opens. Conventional SPT technology is effective in under-compression mode for suppressing low-frequency pressure pulsation levels and reducing energy consumption by the elimination of back-pressure loss inherent with serial dampening. However, it does not work well in over-compression mode, especially for screw compressors operating over a wide range of OC pressure ratio.

To address the over-compression mode problems for screw compressors, a SECAPT (Shunt Enhanced Compression and Pulsation Trap) technology as shown in FIGS. 5*a*-5*d* were disclosed in the U.S. Non-Provisional patent application Ser. No. 17/014,357, filed Sep. 8, 2020. The idea of SECAPT is to allow bi-directional flows through bi-directional orifices or nozzles between the compressor cavity and outlet (discharge port) during the compression phase as to compensate the cavity internal compression. It improves the OC mode operation but suffers increased leakage and power consumption in UC mode due to exposing increased cavity pressure too early to the compressor inlet.

Accordingly, it is always desirable to provide a new design and construction of a screw compressor that is capable of achieving high gas pulsation and NVH reduction at source and improving compressor off-design efficiency without externally connected silencer at discharge or using a slide valve while being kept compact in size and suitable for operating reliably for high efficiency, variable pressure ratio applications at the same time.

SUMMARY

Generally described, the present invention relates to a shunt enhanced decompression and pulsation trap (SEDAPT) for screw compressor having a compression chamber with a suction port and a discharge port, and a pair of multi-helical-lobe rotors housed in the compression chamber forming a series of moving cavities for trapping, compressing and propelling the trapped gas in the cavities from the suction port to discharge port. The SEDAPT comprises an inner casing as an integral part of the compression chamber, and an outer casing surrounding part of the inner casing near the discharge port forming at least one diffusing chamber, therein housed at least one shunt feedback flow loop through at least one outflow orifice or nozzle equipped with a one-direction valve at the outflow orifice or nozzle exit, and the outflow entrance from one of the moving cavities located at least one male lobe span away or totally isolated from the suction port so as to allow only one way flow from the propelled moving cavities to the discharge port during the OC mode. Additionally, therein housed an optional shunt feedback flow loop through at least one inflow orifice or nozzle equipped with an ODV at the inflow orifice or nozzle exit so as to allow only one way flow from the discharge port to the propelled moving cavities during the UC mode. In this way, the SEDAPT automatically bleeds or compensates cavity pressure, in a similar way as deflating or inflating a basketball, by subtracting or adding gas to the cavity in order to meet different outlet pressures, hence getting rid of OC and/or UC before the discharge port opens. SEDAPT eliminates energy waste and reduces gas pulsations and NVH associated with any over-compression, greatly lessens leakage, power consumption and gas pulsations and NVH in under-compression mode.

These and other aspects, features, and advantages of the invention will be understood with reference to the drawing figures and detailed description herein, and will be realized by means of the various elements and combinations particularly pointed out in the appended claims. It is to be understood that both the foregoing summary and the following brief description of the drawings and detailed description of the example embodiments are explanatory of example embodiments of the invention, and are not restrictive of the invention, as claimed.

DETAILED DESCRIPTION OF EXAMPLE EMBODIMENTS

Although specific embodiments of the present invention will now be described with reference to the drawings, it should be understood that such embodiments are examples only and merely illustrative of but a small number of the many possible specific embodiments which can represent applications of the principles of the present invention. Various changes and modifications obvious to one skilled in the art to which the present invention pertains are deemed to be within the spirit, scope and contemplation of the present invention as further defined in the appended claims.

It should also be pointed out that though drawing illustrations and description are devoted to a dual rotor screw compressor for enhancing gas compression and attenuating gas pulsations in the present invention, the principle can be applied to screw vacuum pump and/or other rotor combinations such as a single rotor screw or a tri-rotor screw. The principle can also be applied to other media such as gas-liquid two phase flow as widely used in oil-injected screws for refrigeration. In addition, screw expanders are another variation used to generate shaft power from a media pressure drop.

Basic designs of the SECAPT and its configuration relative to a twin screw compressor are disclosed in the priority U.S. patent application by the applicants, which has been incorporated herein by reference: Ser. No. 17/014,357, filed Sep. 8, 2020, for a "Screw Compressor with A Shunt-Enhanced Compression And Pulsation Trap (SECAPT)". These various embodiments of a SECAPT as exemplified in FIGS. 5*a*-5*d* are configured and operable to meet different outlet pressures (hence getting rid of the under-compression and/or over-compression when the discharge port opens). It eliminates energy waste associated with any over-compression, traps and attenuates gas pulsations and noise in UC mode before the discharge port opens. However, SECAPT suffers increased leakage and power consumption in UC mode due to exposing increased cavity pressure too early to compressor inlet.

Figure 2A:
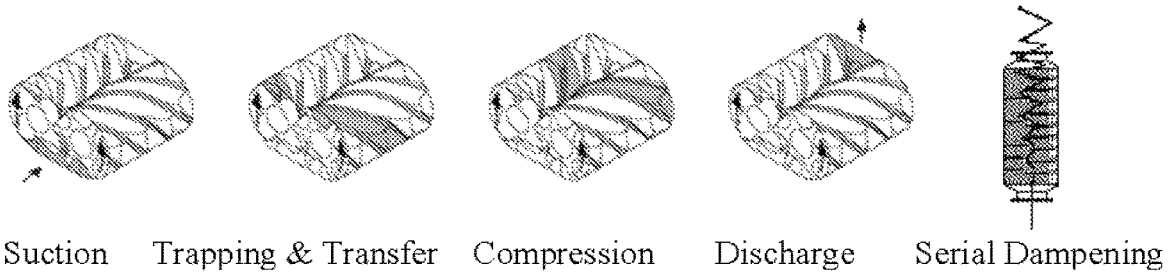
FIG.2a (Prior Art)
FIG. 2*a* shows the phases of a prior-art compression cycle of a screw compressor with a serial discharge dampener.
Figure 2B:
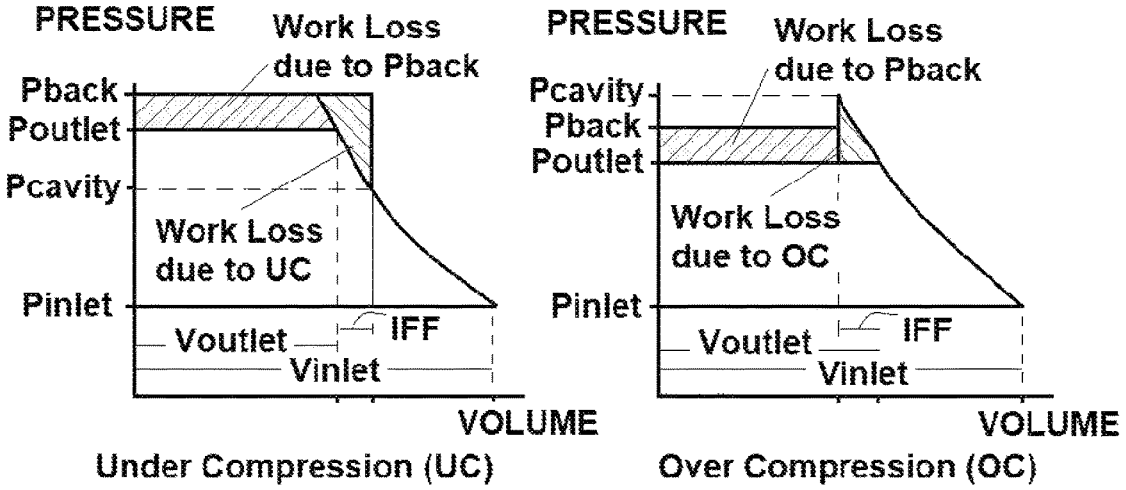
FIG.2b (Prior Art)
FIG. 2*b* is a P-V diagram of the associated energy losses at the compressor discharge for prior-art serial dampening (with back pressure).
Figure 2C:
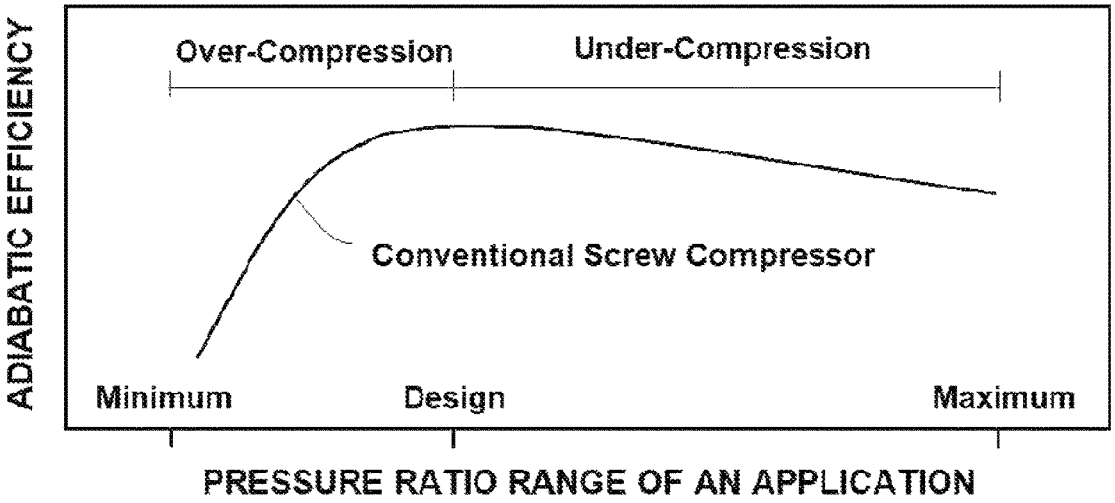
FIG.2c (Prior Art)
FIG. 2*c* shows adiabatic efficiency for a prior-art screw compressor under under-compression and over-compression conditions.
Figure 3A:
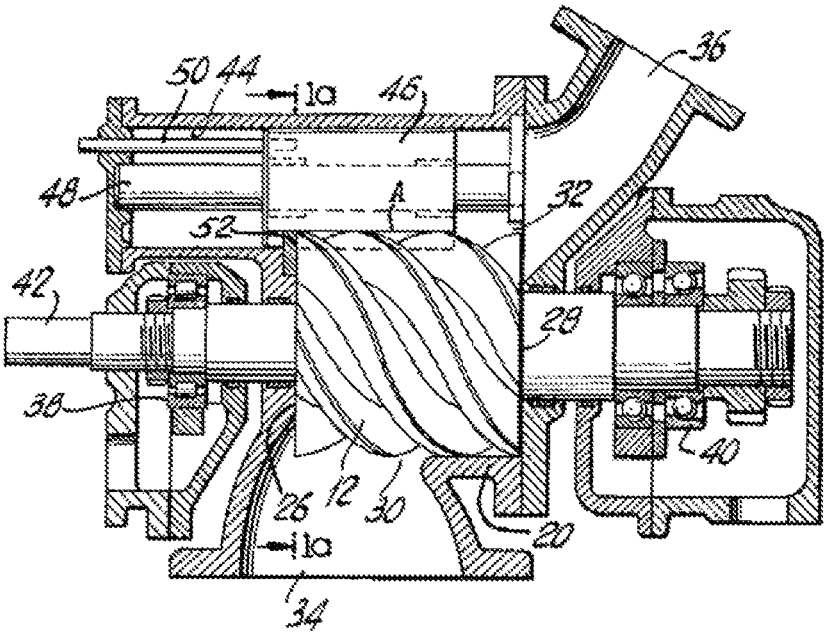
FIG.3a (Prior Art)
FIGS. 3*a* and 3*b* show a typical design of a prior-art screw compressor with a slide valve.
Figure 3B:
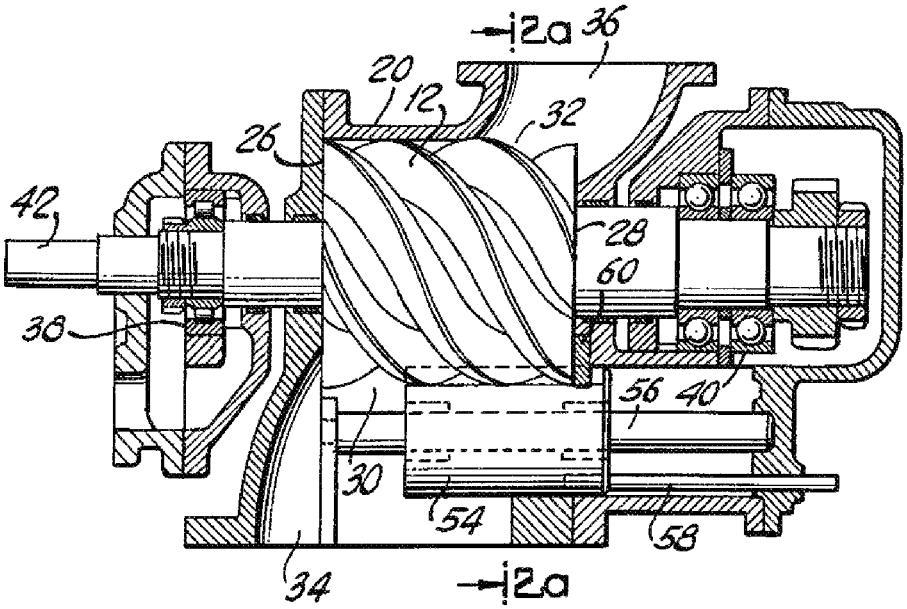
FIG.3b (Prior Art)
Figure 4A:
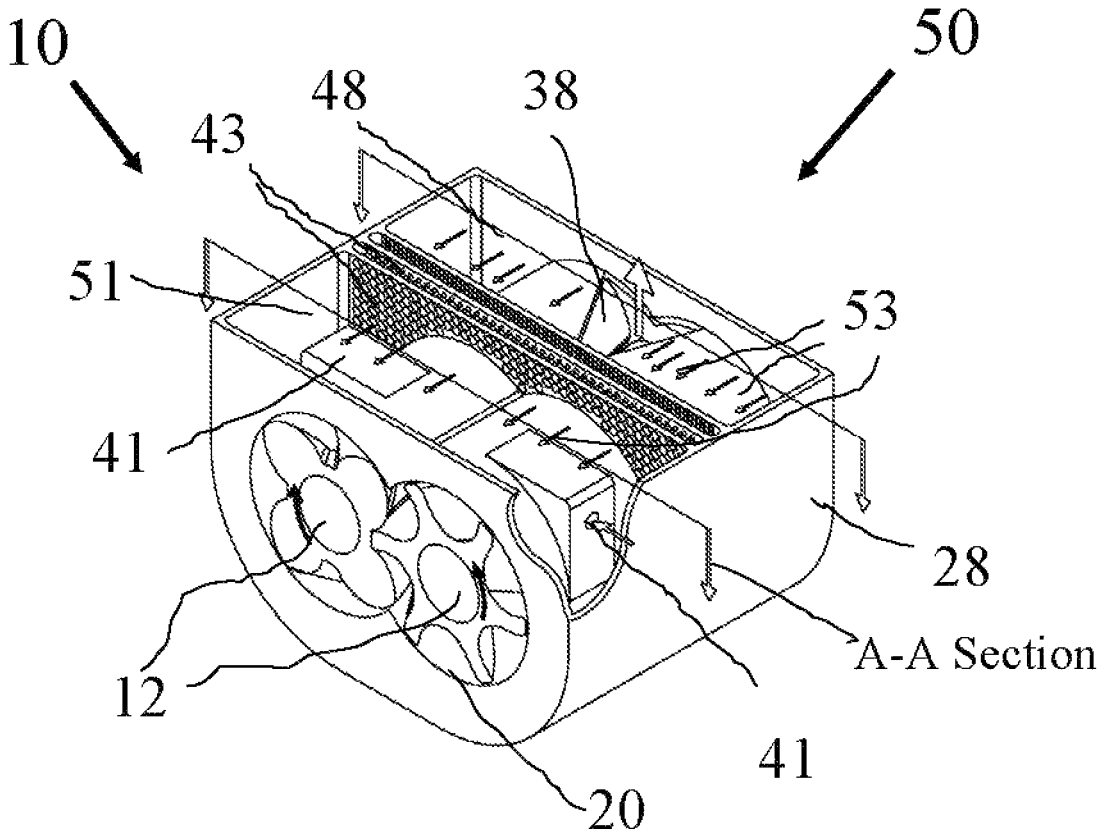
FIG.4a (Prior Art)
FIG. 4*a* shows a perspective view of a prior-art shunt pulsation trap (SPT).
Figure 4B:
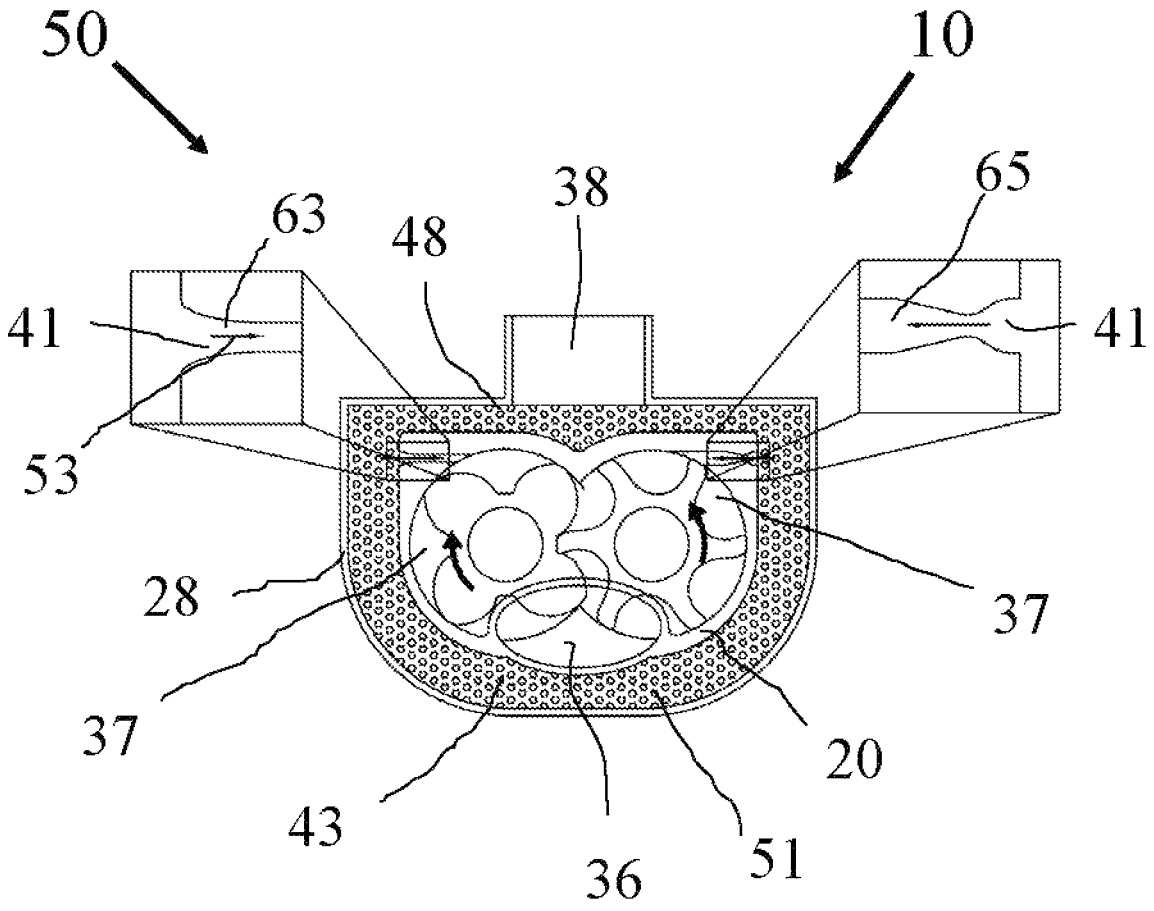
FIG.4b (Prior Art)
FIG. 4*b* is a cross-sectional view of (A-A) section of prior-art shunt pulsation trap of FIG. 4*a* showing different options of injection orifice or nozzle.
Figure 5A:
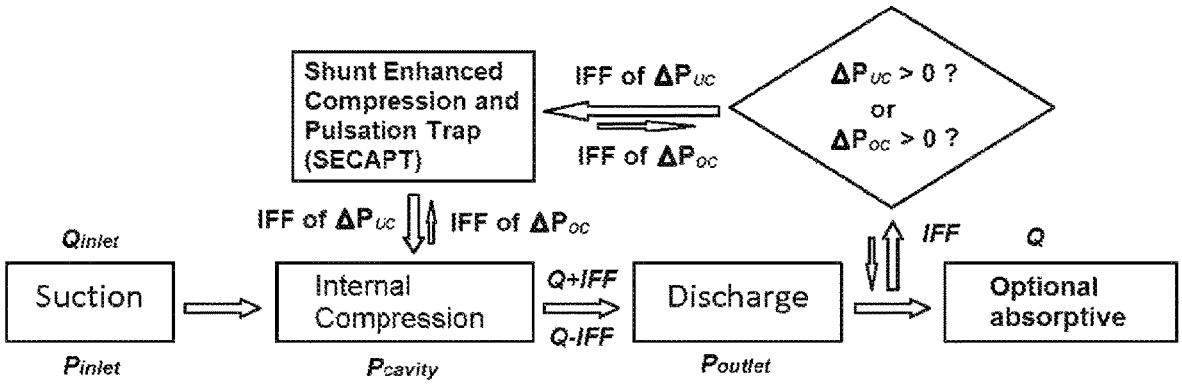
FIG.5a (Prior Art)
FIG. 5*a* is a flow chart of the phases of a compression cycle of shunt enhanced compression and pulsation traps (SECAPTs) of prior-art during an under-compression condition and an over-compression condition.
Figure 5B:
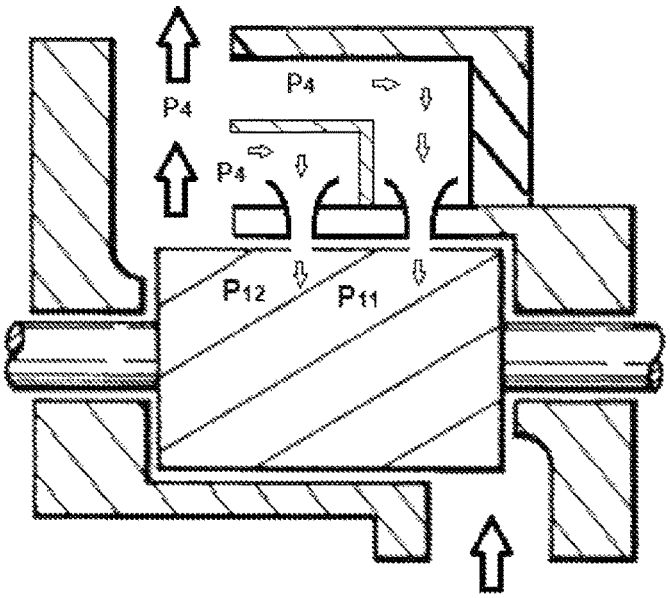
FIG.5b (Prior Art)
FIG. 5*b* is a cross-sectional view of a two-stage SECAPT of prior-art, showing an under-compression condition for both stages.
Figure 5C:
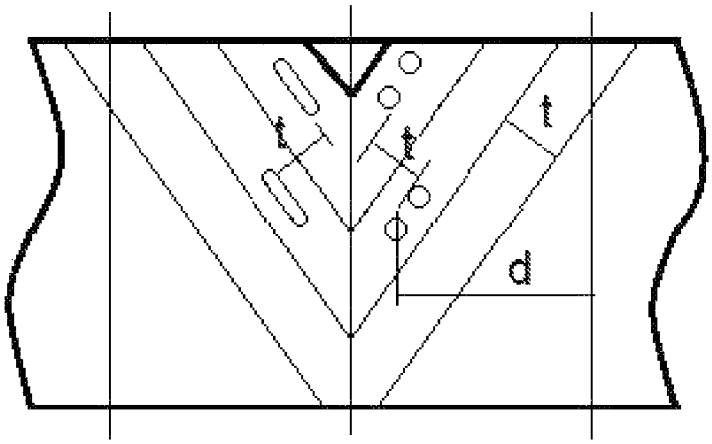
FIG.5c (Prior Art)
FIG. 5*c* is an unwrapped view of the two-stage SECAPT of prior-art of FIG. 5*b*.
Figure 5D:
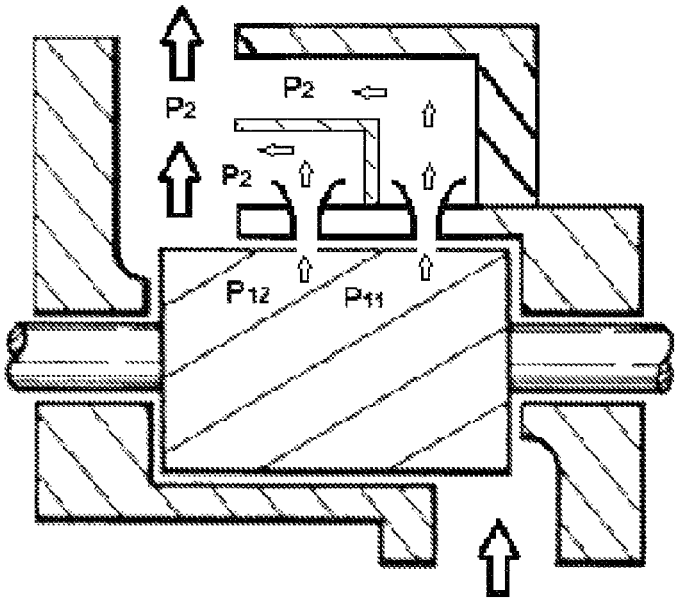
FIG.5d (Prior Art)
FIG. 5*d* is a cross-sectional view of the two-stage SECAPT of prior-art, showing an over-compression condition for both stages.
Figure 6A:
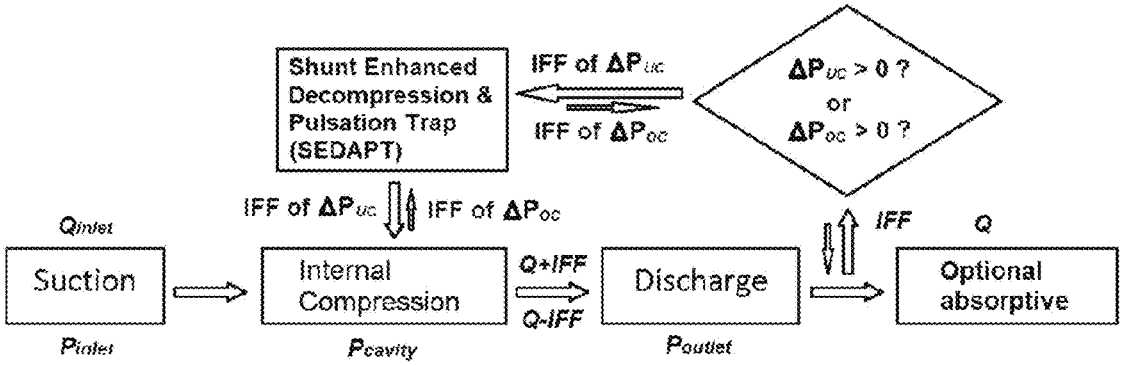
FIG. 6*a* is a flow chart of the phases of a compression cycle of shunt enhanced decompression and pulsation traps (SEDAPTs) according to the present invention, showing an under-compression condition and an over-compression condition.
Figure 6B:
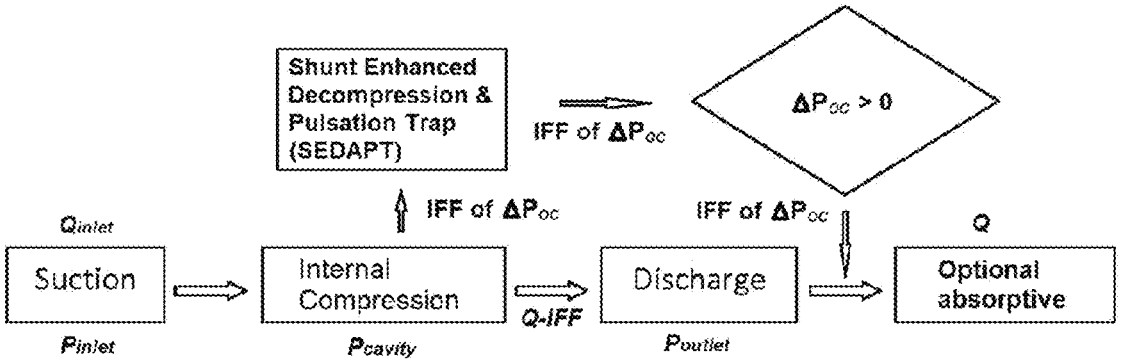
FIG. 6*b* is a flow chart of the phases of a compression cycle of shunt enhanced decompression and pulsation traps (SEDAPTs) according to the present invention, showing 100% over-compression condition.

To illustrate the principles of the present invention, FIG. 6*a* is a flow chart of a screw compression cycle with the addition of a shunt enhanced decompression and pulsation trap (SEDAPT) according to example embodiments of the present invention, linking the internal compression phase to the discharge pressure. In extreme, FIG. 6*b* shows a flow chart of a screw compression cycle of the SEDAPT for a 100% over-compression condition when the design pressure ratio of the compressor is set for the maximum operating pressure ratio of the application. In broad terms, a SEDAPT is used to assist internal compression (IC), to trap and attenuate gas pulsations and noises, and to improve off-design efficiency, without using a slide valve and/or a traditional serial pulsation dampener. As illustrated in FIG. 6*a*, a SEDAPT involves modifications to a standard screw compression cycle from a serial mode, that is, from internal compression and dampening in series as shown in the prior art of FIG. 2*a*, to a parallel mode where IC and SEDAPT are carried out simultaneously and synergistically during a much longer time interval. Any deviation of the pressure in the compressor cavity from the target outlet pressure, either due to an under-compression $\Delta P_{UC}$ ($=P_{outlet}-P_{cavity}$) or an over-compression $\Delta P_{OC}$ ($=P_{cavity}-P_{outlet}$), would immediately trigger a feedback flow in the form of induced fluid flow (IFF) between the cavity and outlet that adds or subtracts extra gas molecules to or from the cavity in such a way as to diminish the pressure difference ($\Delta P$) BEFORE the discharge valve opens. This way of compensation of the screw cavity pressure is similar to inflating or deflating a basketball by injecting or releasing gas into or from the cavity. By the compounded compression scheme of IC and SEDAPT, any UC or OC pressure deficit or build-up at the compressor discharge will be minimized so that there would be no need to use a downstream dampener. However, an optional absorptive silencer could be used if flow induced broadband noise needs to be attenuated. When a screw compressor is equipped with the SEDAPT, there exist both a reduction in the gas pulsation and induced noises transmitted from screw compressor outlet to downstream flow as well as major power savings, hence improving its adiabatic off-design efficiency across the whole operating pressure range as shown in FIG. 6*c* which is especially significant for over-compression operation.

Figure 7A:
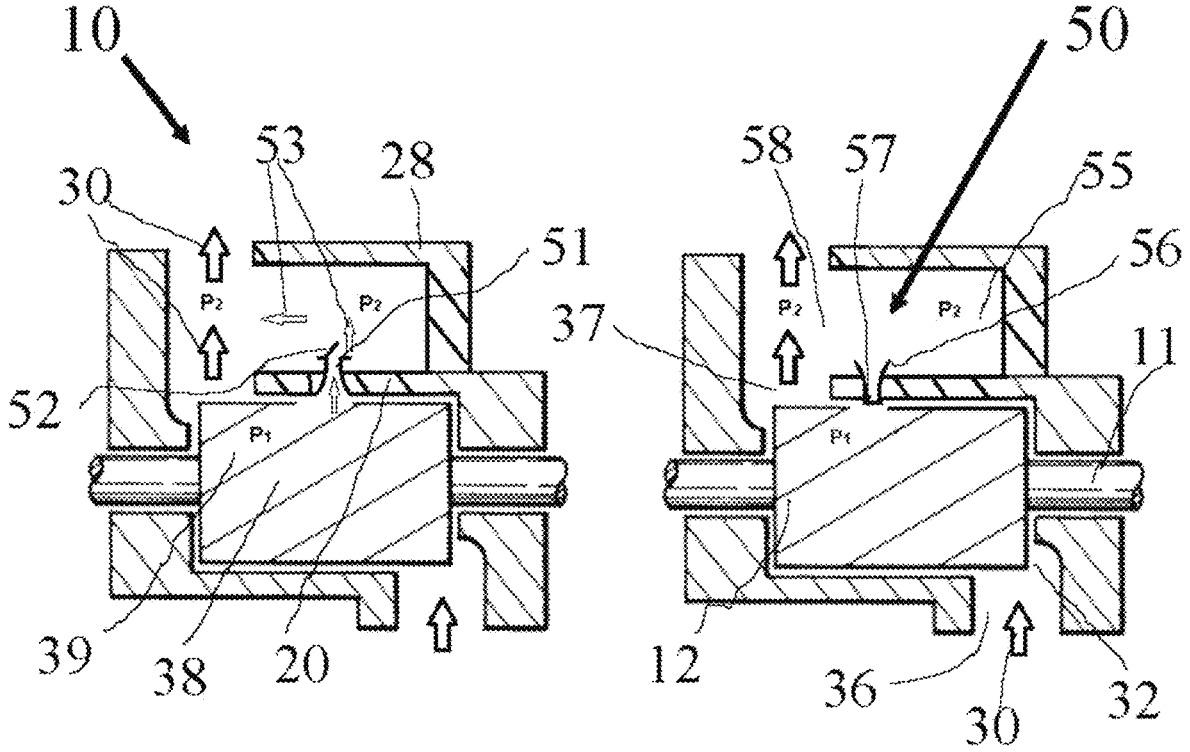
FIG. 7*a* is a cross-sectional view of a one-stage SEDAPT according to a first example embodiment of the invention, showing an OC outflow orifice equipped with ODV (one direction valve) open on left while an UC inflow nozzle with ODV closed on right under an over-compression condition.
Figure 7B:
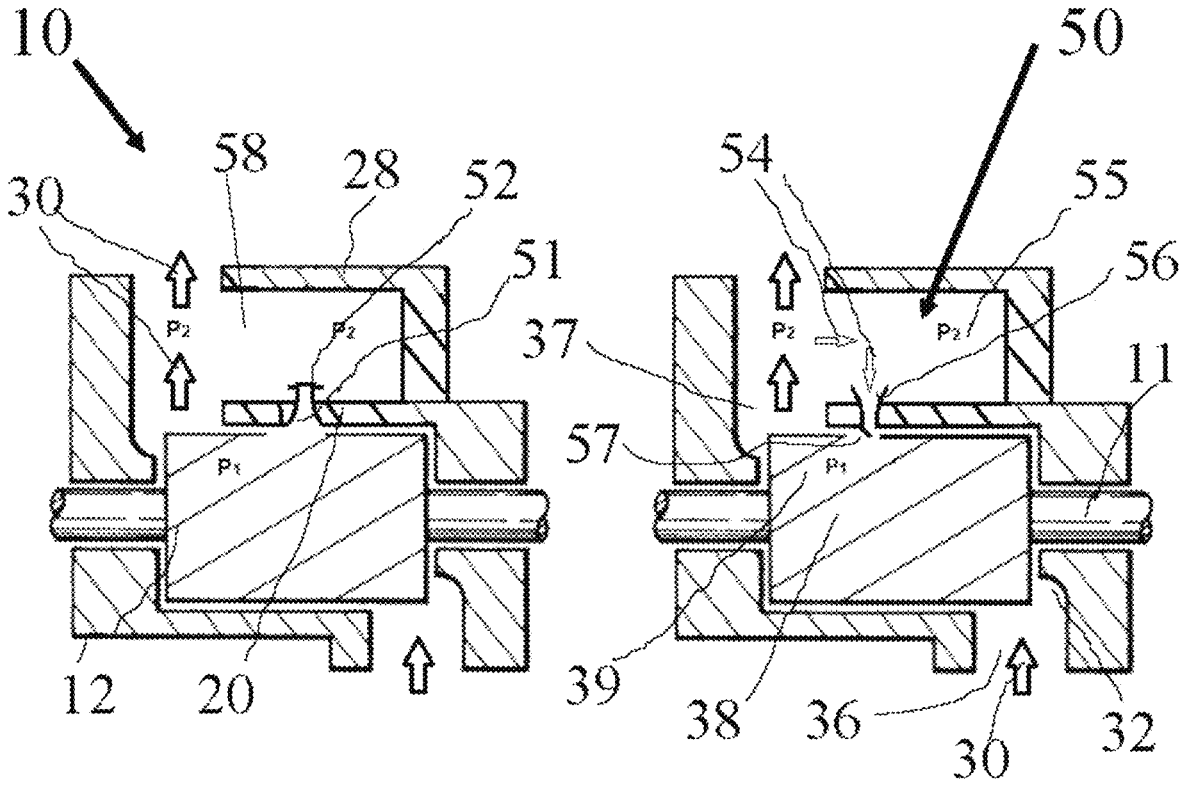
FIG. 7*b* is a cross-sectional view of the one-stage SEDAPT according to a first example embodiment of the invention, showing an OC outflow orifice equipped with ODV closed on left while an UC inflow nozzle with ODV open on right under an under-compression condition.
Figure 7C:
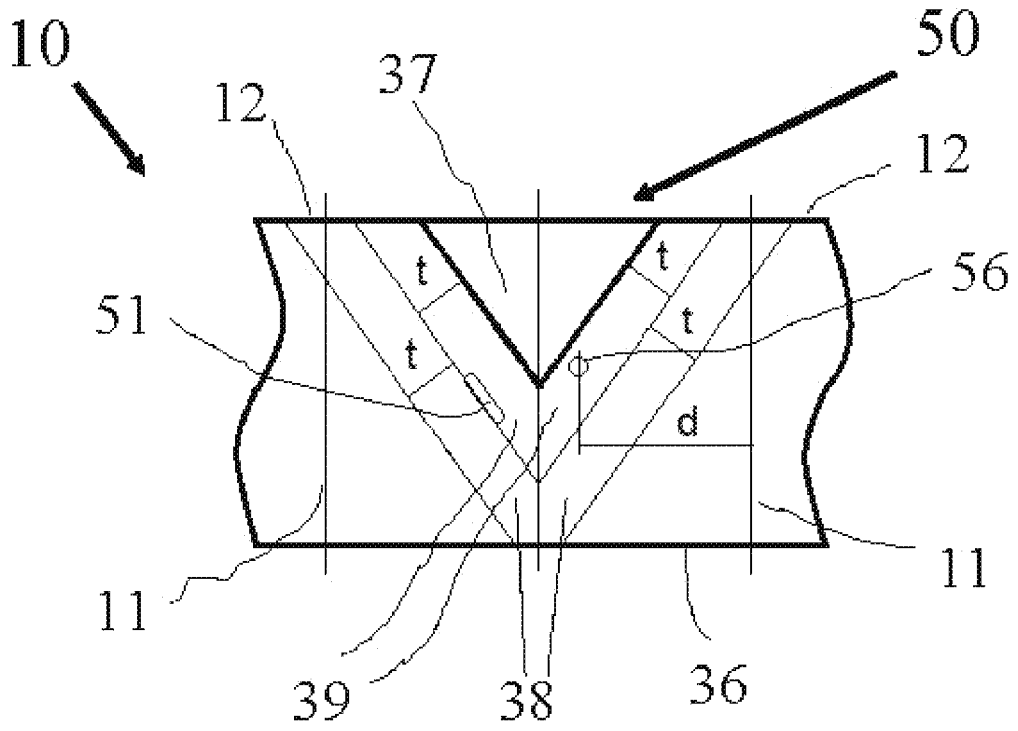
FIG. 7*c* is a view of FIG. 7*a* and FIG. 7*b*, unwrapped in a plane of the compression chamber internal surface, showing an OC outflow orifice entrance (on left) and UC inflow nozzle exit (on right) positions interfacing with moving cavities.

Referring to FIGS. 7*a* to 7*c*, there is shown a typical arrangement of a screw compressor 10 with a shunt enhanced decompression and pulsation trap (SEDAPT) apparatus 50 according to a first example embodiment. Typically, the screw compressor 10 has two rotors 12 integrated with two rotor shafts 11, respectively, where one rotor shaft 11 is driven by an external rotational driving mechanism (not shown). The rotors 12 are typically driven through a set of timing gears, in the case of dry running, or they drive each other directly in the case of oil injected. The twin rotors 12 are typically a pair of multi-helical-lobe rotors, one male and one female, housed in the compression chamber 32 forming a series of moving cavities such as 38 and 39 for trapping, compressing, and propelling the trapped gas in the cavities 38 and 39 from a suction port 36 to a discharge port 37 of the compressor 10. The screw compressor 10 also has an inner casing 20 as an integral part of the compression chamber 32, wherein rotor shafts 11 are mounted on an internal bearing support structure, not shown. The casing structure further includes an outer casing 28 surrounding part of the inner casing 20 near the discharge port 37 forming at least one diffusing chamber 55.

As a novel and unique feature of the present invention, a SEDAPT apparatus 50 is comprised of at least one OC outflow orifice 51 with its entrance branching off from the compression chamber 32 and with an ODV 52 installed near the outflow orifice 51 exit path into the diffusing chamber 55 and a feedback region 58 so as to only allow one way flow from the propelled moving cavities to the discharge port during the OC mode. As shown in FIGS. 7*a* and 7*c*, the starting line of the OC outflow orifice 51 entrance is located at one of the moving cavities 38 or 39 at least one lobe span or a screw pitch away from the suction port 36 closing line. FIG. 7*c* also shows two types of flow orifice and nozzle 51 & 56 can be used: on the left is an OC outflow orifice 51 with the cross-sectional shape transition from rectangular to circular while keeping the same or gradually decreasing cross-sectional area, shown in FIG. 8*b*, from the moving cavity 39 into the diffusing chamber 55; and on the right is an UC inflow nozzle 56 with the circular cross-sectional shape and its cross-sectional area decreasing from the diffusing chamber 55 into the moving cavity 39 shown in FIG. 8*d*. FIG. 7*a* shows the flow pattern for an over-compression mode where the large directional arrows 30 still show the direction of the cavity flow as propelled by the rotors 12 from the suction port 36 to the discharge port 37 of the compressor 10, while induced feedback outflow IFF 53 as indicated by the small arrows goes from the moving cavity 39 through the OC outflow orifice 51 now opened by ODV 52 into the diffusing chamber 55, and releasing into the outlet 58 that merges with the discharge flow 30. On the other hand, FIG. 7*b* shows the flow pattern for an under-compression mode where the large directional arrows 30 show the direction of the cavity flow as propelled by the rotors 12 from the suction port 36 to the discharge port 37 of the compressor 10, while induced feedback inflow IFF 54 as indicated by the small directional arrows goes from the feedback region (trap outlet) 58 through the diffusing chamber 55, then converging to the UC inflow nozzle (trap inlet) 56 through now opened ODV 57 and releasing into the moving cavity 39. It should be pointed out that the UC inflow nozzle is positioned as far away, distance d on FIG. 7*c*, from the rotating axis 11 as possible and directed at about the same direction as the direction of the rotating rotor 12 to assist rotating, e.g., positioned with a directional axis that is parallel to a tangent to the angular direction of the rotating rotors at that location.

Figure 6C:
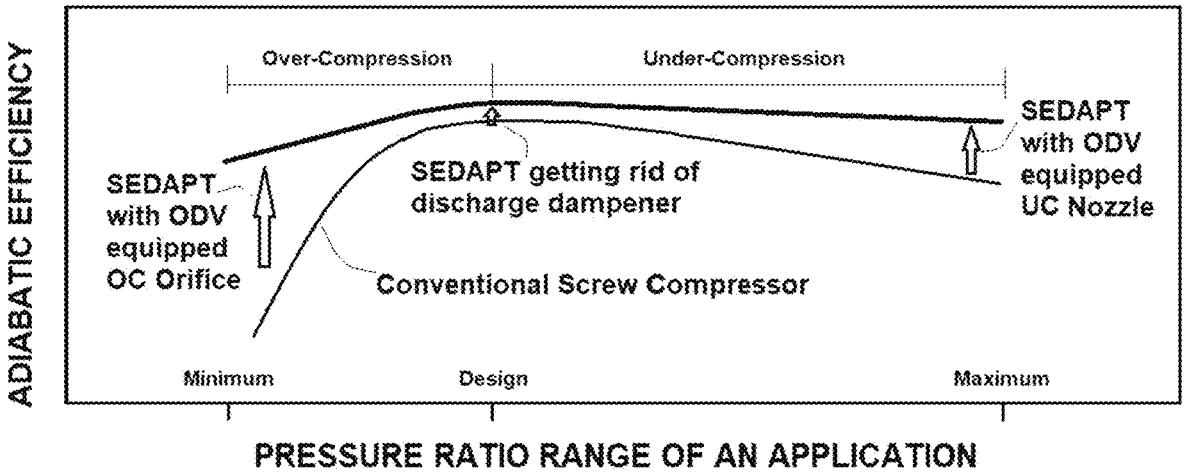
FIG. 6*c* shows improvements of adiabatic efficiency with the present invention SEDAPT under under-compression and over-compression conditions.

When a screw compressor 10 is equipped with the SEDAPT apparatus 50 of the present invention, there exist both a reduction in the gas pulsation and induced noises transmitted from screw compressor outlet to downstream flow as well as major power savings, hence improving its adiabatic off-design efficiency across the whole operating pressure range as shown in FIG. 6*c*, which is especially significant for over-compression operation. The theory of the operation underlying the SEDAPT apparatus 50 of the present invention can be described as follows.

As illustrated in FIGS. 7*a* and 7*c* for an over-compression mode, the ODV 52 equipped OC outflow orifice 51 is designed to assist the internal compression from the moment when the gas pressure $P_1$ of cavity 39 is slightly over the minimum required discharge pressure $P_2$ of an application of the compressor 10. As shown in FIG. 7*a* when $P_1>P_2$, the "moving cavity" 39 with slightly higher gas pressure $P_1$ forces the ODV 52 of the OC outflow orifice 51 to open to the diffusing chamber 55 with slightly lower pressure $P_2$, relieving any excessive pressure generated inside the compressor cavity 39 by the internal compression. Since the internal compression is gradual in nature corresponding to the gradual volume reduction of the cavity 39, the induced outflow IFF 53 is gradual and small in magnitude as well as indicated by small flow arrows in FIGS. 6*a*-6*b*, not causing large gas pulsations. The OC induced IFF 53 is out flowing, as indicated by the small directional arrows in FIG. 7*a*, from the cavity 39 through the outflow orifice 51 into the diffusing chamber 55, and releasing into the outlet 58 that merges with the discharge flow 30. This eliminates a significant energy waste associated with any over-compression. Also shown on the right side of FIG. 7*a*, the UC inflow nozzle's ODV keeps closed during all over-compression conditions.

On the other hand for an under-compression mode when $P_2>P_1$, the theory of operation underlying the SEDAPT apparatus 50 is different. As illustrated in FIGS. 7*b* and 7*c*, the UC inflow nozzle is designed to assist the internal compression just before cavity opening to discharge when the gas pressure $P_1$ of cavity 39 is well below the maximum required discharge pressure $P_2$ of an application of the compressor 10. As the "moving cavity" 39 with much lower gas pressure $P_1$ is suddenly exposed, through the UC inflow nozzle 56 now opened by ODV 57, to the much higher pressure $P_2$ of the diffusing chamber 55, a shock-tube-like reaction is triggered, as disclosed in the co-owned U.S. Pat. No. 9,155,292. This generates, at the inflow nozzle throat 56 where the sudden opening of ODV 57 taking place, an instant gas pulsation in the form of CW-IFF-EW with CW (not shown) and IFF 54 going into the cavity 39 while EW (not shown) coming out of the nozzle 56 towards the diffusing chamber 55 and compressor discharge port 37.

Figures 1A, 1B:
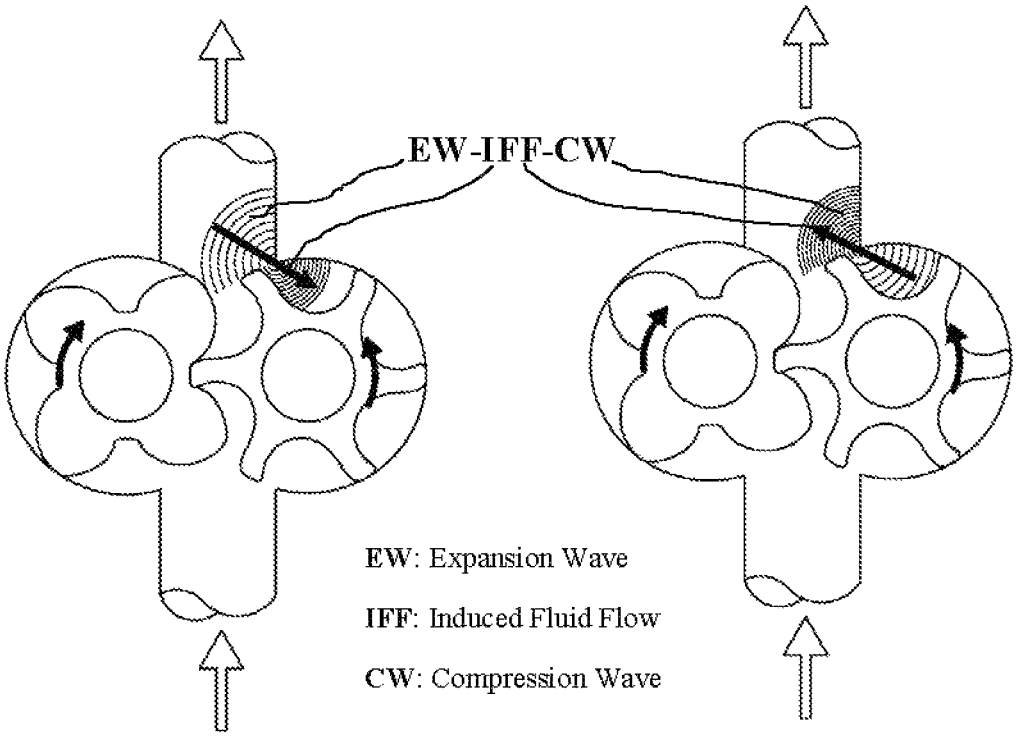
FIG.1a (Prior Art) FIG.1b (Prior Art)
FIGS. 1*a* and 1*b* are a cross sectional view showing the triggering mechanism of gas pulsation generation, in the form of CW-IFF-EW which stands for Compression Wave—Induced Fluid Flow—Expansion Wave, at the compressor discharge for an under-compression and an over-compression condition for a prior-art screw compressor.
Figure 1C:
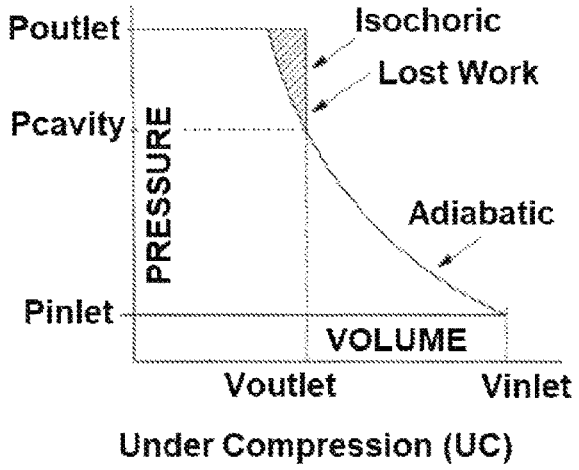
FIG.1c (Prior Art)
FIGS. 1*c* and 1*d* are P-V diagrams of the associated energy losses for an under-compression and an over-compression condition for a prior-art screw compressor.
Figure 1D:
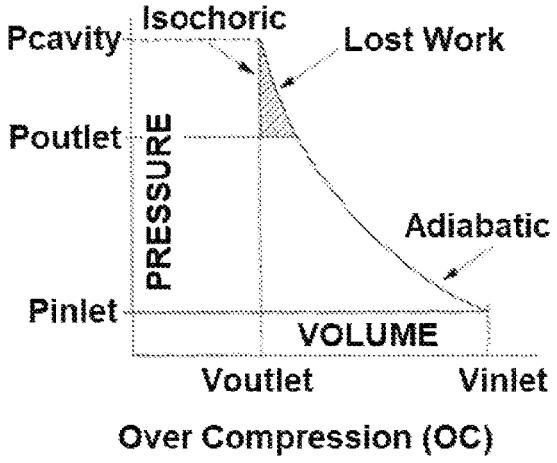
FIG.1d (Prior Art)

There are several advantages provided by the SEDAPT when operating under an under-compression mode. First of all, the required mass flow is more efficiently transported using a nozzle 56 into the "starved" or under-compressed cavity 39 to minimize fill-in time and pulsation generation at discharge. It can be seen that the required mass inflow 54 is first "borrowed" from the outlet area 37 and then "returned" to the outlet area 37 by a shunt feedback flow loop as shown as larger IFF arrow in FIG. 6*a* so that the induced inflow 54 is not lost in the process. The amount of the feedback inflow 54 is designed to compensate the internal compression before discharge in such a way that the pressure difference $\Delta P_{UC}$ or $\Delta P_{OC}$ would be reduced close to nearly zero at discharge as shown in FIG. 6*a*. Because the speed of the jet flow at the nozzle throat can be close or equal to the speed of sound for high $\Delta P_{UC}$, much faster than the speed of moving cavity 39, it is possible for the scheme to work for high speed dry screw compressors where variable Vi design does not work. Secondly from a noise reduction point of view, using a nozzle 56 as a trap would isolate the high velocity jet noises inside the cavity 39 before discharging as long as the nozzle throat 56 is choked so that no CW and jet induced sound could escape or propagate upstream through the nozzle throat 56. When the nozzle throat 56 is NOT choked, the CW and jet noises inside the cavity 39 will be reduced greatly due to small throat area for the noise to escape out. Furthermore, the velocity field on the diverging side of the nozzle 56 that is opened to the diffusing chamber 55 and downstream outlet 37 is of much lower velocity, hence much lower the flow induced noises. Thirdly, from an energy conservation point of view, the traditionally lost work associated with UC, shown in prior-art FIG. 1*c* as the shaded area, could now be partially recovered because the high velocity jet flow 56 is now directed to assist to propel or impulse the rotor 12 as shown in FIG. 7*c*, like a Pelton Wheel. In a conventional serial scheme shown in prior-art FIG. 2*a*, the backflow jet is generally in the direction against the rotor rotating, resulting in doing negative work for the compressor system. The last but not least important is to delay the UC nozzle opening until just before discharge opening in order to minimize the leakage suffered by SECAPT that opens at the same timing as OC orifice or nozzle, too early.

Figure 8A:
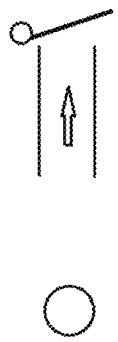
FIG. 8*a* shows side and top cross-sectional views of an ODV equipped OC outflow orifice with a same cross-sectional shape and area between the cavity and the diffusing chamber of a SEDAPT.
Figure 8B:
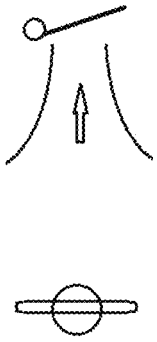
FIG. 8*b* shows side and top cross-sectional views of an ODV equipped OC outflow orifice with a same cross-sectional area but different cross-sectional shape gradually transitioning from rectangular to circular from the cavity to the diffusing chamber of a SEDAPT.
Figure 8C:
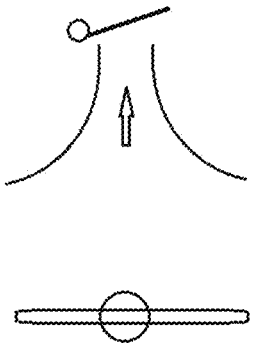
FIG. 8*c* shows side and top cross-sectional views of an ODV equipped OC outflow orifice with a cross-sectional shape transition between rectangular and circular and a gradually decreasing cross-sectional area (converging) between the cavity and the diffusing chamber of a SEDAPT.
Figure 8D:
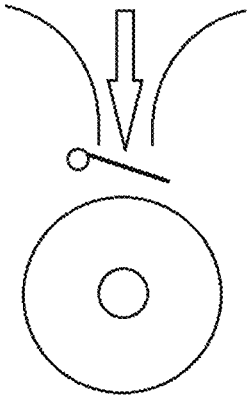
FIG. 8*d* shows side and top cross-sectional views of an ODV equipped UC inflow nozzle with a circular cross-sectional shape and a cross-sectional area decreasing from the diffusing chamber through the nozzle throat into the cavity of a SEDAPT.

To facilitate and optimize the feedback flow 53 or 54 at the outflow orifice 51 or inflow nozzle 56 in its desired direction between the cavity 39 and diffusing chamber 55, more than one orifice or nozzle can be used to feed both male and female sides of the cavity 39, and/or the nozzle/s can optionally be in the form of a circular hole (orifice) or a slot tap arranged in parallel with the lobe seal line of the cavity 39, for illustration purposes, both are shown in FIG. 7*c*. Moreover, if the circular cross-sectional shape is used with constant cross section area, the cross-sectional shape can be designed to stay the same as shown in FIG. 8*a* or gradually transitioned to a rectangular shape shown in FIG. 8*b* into the cavity 39 and its long side oriented generally along the cavity seal line. For the latter case, the cross sectional area can also be gradually decreasing to minimize the exit area hence ODV size as shown in FIGS. 8*c*-8*d*. Replacing a circular cross-sectional shape in FIG. 8*a* with a slot as shown in FIGS. 8*b*-8*c* will also reduce the stage spacing defined as the sum of the screw pitch and slot width perpendicular to the rotor sealing line, hence gaining more timing for the second stage operation. Furthermore, the slot shape into the cavity 39 would help flow exchange between the oblong shaped cavity 39 and the diffusing chamber 55 especially for high speed dry screw application.

If the range of the pressure ratio variation or the extent of OC is small, a one-stage SEDAPT with one ODV equipped OC orifice is enough to cover the compounded compression phase when the distance between the orifice or nozzle 51 opening to discharge port 37 opening is smaller than one lobe span or screw pitch t as shown in FIG. 7*c*. However, for some applications where the range of pressure ratio variation of OC is large, a two-stage SEDAPT with two ODV equipped OC orifices can be used to cover the compounded compression phase when the distance between the closing of the first orifice or nozzle opening to the discharge port opening is larger than one lobe span or screw pitch. The rule is that each SEDAPT cavity 38 or 39 should always be in communication with the compressor outlet 37 at any instant after being connected, but cavities 38 and 39 never communicate with each other. Based on this rule, the start of the $2^{nd}$ stage orifice or nozzle should be located about one screw pitch away, or totally sealed or isolated, from the end of the $1^{st}$ orifice or nozzle and within the last screw pitch before the discharge port opening. Likewise, if a two-stage SEDAPT is not enough to cover the compounded compression phase, a three-stage SEDAPT ensues.

Figure 9A:
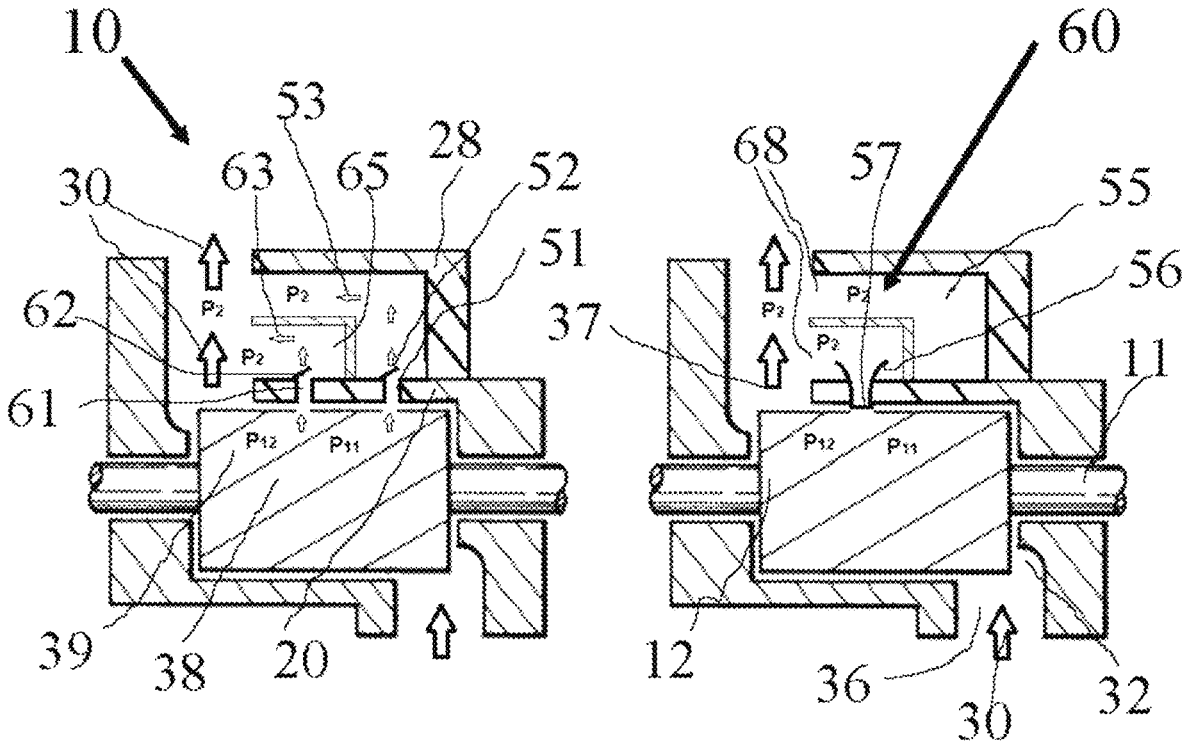
FIG. 9*a* is a cross-sectional view of a two-stage SEDAPT according to a second example embodiment of the invention, showing both ODV equipped OC orifices open on left while an ODV equipped UC nozzle closed on right under an over-compression condition.
Figure 9B:
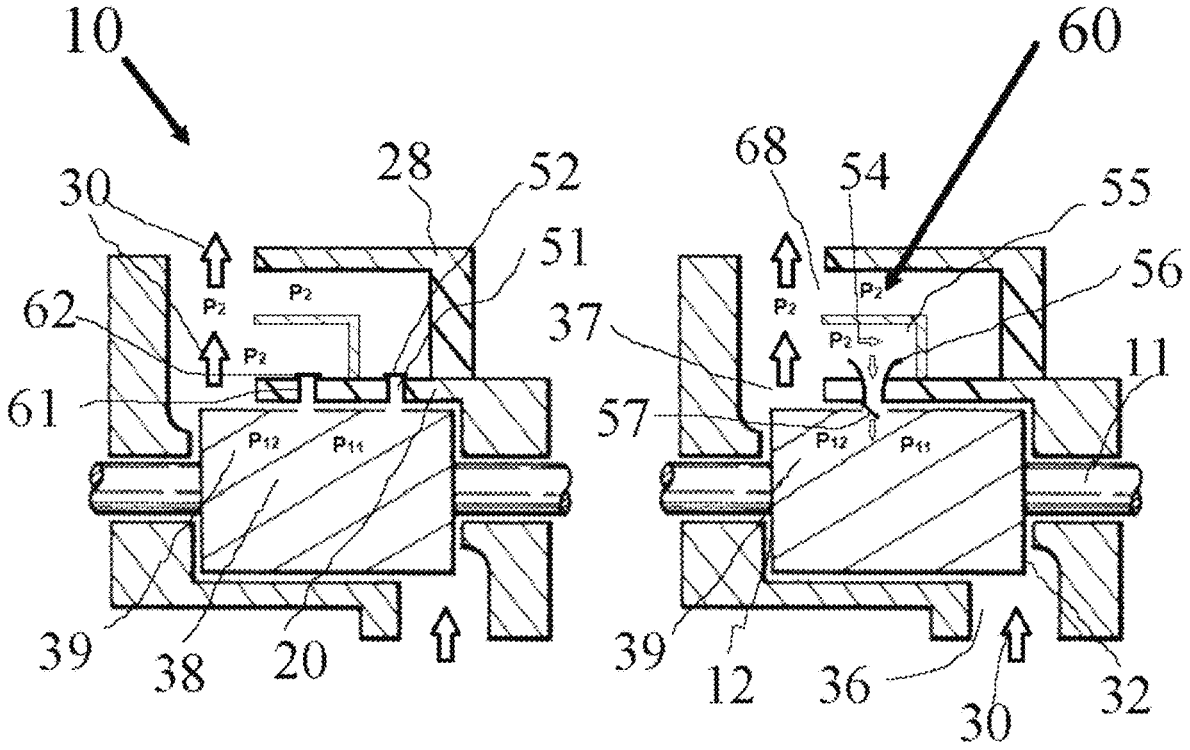
FIG. 9*b* is a cross-sectional view of the two-stage SEDAPT according to a second example embodiment of the invention, showing both ODV equipped OC orifices closed on left while an ODV equipped UC nozzle open on right under an under-compression condition.
Figure 9C:
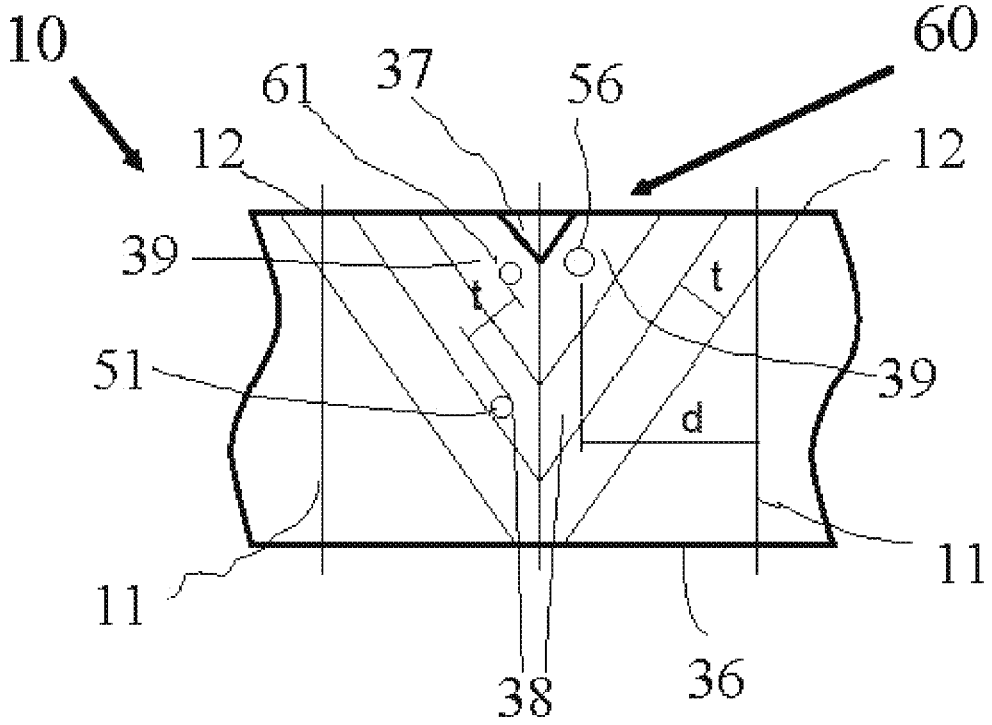
FIG. 9*c* is a view of FIG. 9*a* and FIG. 9*b*, unwrapped in a plane of the compression chamber internal surface, showing an OC orifice entrance (on left) and UC nozzle exit (on right) positions interfacing with moving cavities.

Referring to FIGS. 9*a* to 9*c*, there is shown a typical arrangement of a two-stage SEDAPT with two ODV equipped OC outflow orifices according to a second example embodiment of a screw compressor 10 with a shunt enhanced decompression and pulsation trap (SEDAPT) apparatus 60. The construction of the screw compressor 10 and the first stage of the SEDAPT with ODV equipped OC outflow orifice apparatus 60 can be the same as for the one stage SEDAPT with ODV 52 equipped OC outflow orifice 51 apparatus 50 as discussed above. However, a second stage of SEDAPT with ODV equipped OC outflow orifice apparatus 60 is added which is further comprised of at least one outflow OC outflow orifice 61 with its entrance branching off from the compression chamber 32 and with an one direction valve (ODV) 62 installed near the outflow orifice exit path into the diffusing chamber 65 and a feedback region 68 so as to only allow one way flow from the propelled moving cavities to the discharge port during the OC mode. As shown in FIGS. 9*a* and 9*c*, the starting line of the first OC outflow orifice 51 entrance is still located at the moving cavity 38 about one lobe span or one screw pitch away, or totally sealed or isolated, from the suction port 36 closing line, and the start of the second OC outflow orifice 61 entrance is located about one screw pitch away, or totally sealed or isolated from the closing of the first nozzle 51. FIG. 9 also shows two types of flow orifice and nozzle 51 & 56 can be used: on the left is an OC outflow orifice 51 & 61 with the same cross-sectional shape and area and on the right is an UC inflow nozzle 56 with the circular cross-sectional shape and its cross-sectional area decreasing from the diffusing chamber 55 into the moving cavity 39. FIG. 9*a* shows the flow pattern for an over-compression mode where the large directional arrows 30 still show the direction of the cavity flow as propelled by the rotors 12 from the suction port 36 to the discharge port 37 of the compressor 10, while induced feedback outflow IFFs 53 & 63 as indicated by the small arrows go from the moving cavity 38 & 39 through the OC outflow orifices 51 & 61 now opened by ODVs 52 & 62 into the diffusing chambers 55 & 65 respectively, and both releasing into the outlet 68 that merges with the discharge flow 30. On the other hand, FIG. 9*b* shows the flow pattern for an under-compression mode where the large directional arrows 30 show the direction of the cavity flow as propelled by the rotors 12 from the suction port 36 to the discharge port 37 of the compressor 10, while induced feedback inflow IFF 54 as Indicated by the small directional arrows goes from the feedback region (trap outlet) 68 through the diffusing chambers 55, then converging to the UC inflow nozzle (trap inlet) 56 through now opened ODV 57 and releasing into the moving cavity 39.

In addition to a two-port configuration for a screw compressor pressure application discussed above for the first and second example embodiments, a three-port configuration can be used for a screw vacuum pump application for pulling deep vacuum. In a vacuum pump embodiment, the suction port of the compressor is connected to a process or a vessel where a deep vacuum is to be created while the outlet port of the compressor is connected through a silencer to atmosphere. In addition, a third port is added that is also open to atmosphere to allow direct communication between compressor cavities and atmosphere. Thus under the under-compression mode, this third port allows cool atmospheric air into the compressor cavities through the SEDAPT to extend the pressure ratio range, e.g., from about 4/1 to about 20/1 or more.

Figure 10A:
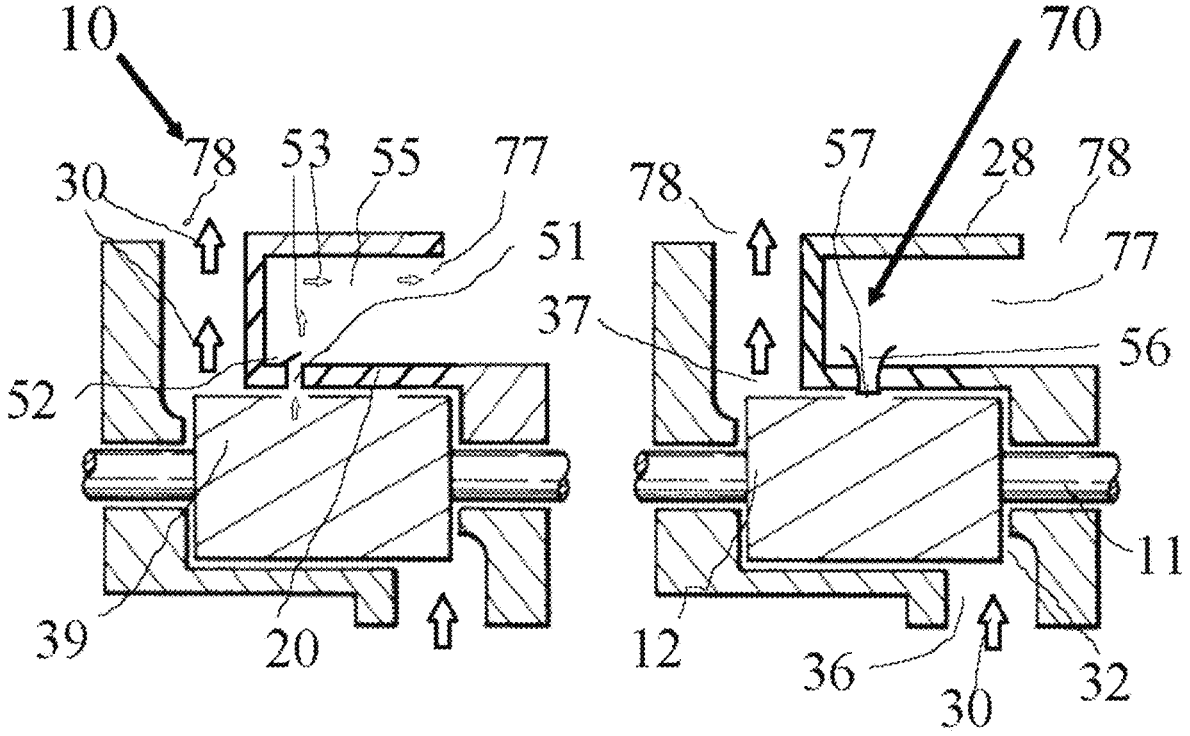
FIG. 10*a* is a cross-sectional view of a one-stage SEDAPT according to a third example embodiment of the invention, showing the SEDAPT in a deep vacuum mode with one ODV equipped OC orifice open on left while one ODV equipped UC nozzle closed on right under an over-compression condition.
Figure 10B:
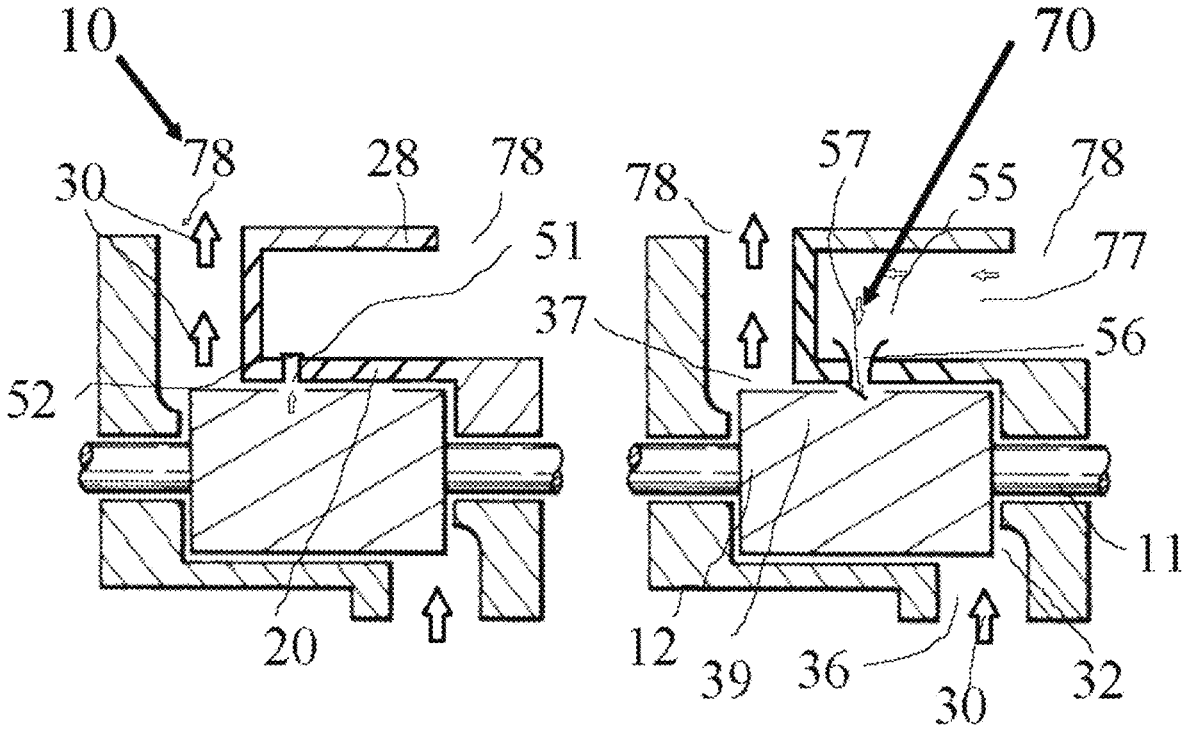
FIG. 10*b* is a cross-sectional view of a one-stage SEDAPT according to a third example embodiment of the invention, showing the SEDAPT in a deep vacuum mode with one ODV equipped OC orifice closed on left while one ODV equipped UC nozzle open on right under an under-compression condition.

Referring to FIGS. 10*a* and 10*b*, there are shown typical arrangements of a one-stage SEDAPT with one ODV equipped OC orifice and one ODV equipped UC nozzle, according to a third example embodiment of a screw compressor 10 with a shunt enhanced decompression and pulsation trap (SEDAPT) apparatus 70 under the OC and UC conditions, respectively. The difference of the construction of the screw compressor 10 with the SEDAPT apparatus 70 relative to that of the SEDAPT apparatus 50 of the first embodiment is that an access port or region 77 is included, instead of the feedback region 58, to connect the compressor cavity 39 directly with atmosphere 78 through the SEDAPT apparatus 70, instead of merging with the compressor outlet 37. A typical mode of operation for a one-stage SEDAPT 70 under an OC condition, for example as shown on the left side of in FIG. 10*a* is first releasing excessive flow 53 from the cavity 39 through the orifice 51 with now opened ODV 52 into the diffusing chambers 55 connected to the port 77 and into the atmosphere 78 when the outlet pressure is less than the design pressure inside the cavity of the compressor 10 to get rid of any over-compression. Also shown on the right side of FIG. 10*a*, the ODV 57 equipped UC nozzle 56 keeps closed during all over-compression conditions. A typical mode of operation for a one-stage SEDAPT 70 under an UC condition, for example as shown on the right side of in FIG. 10*b* is different with the closing of the ODV 52 of the OC orifice 51 and the opening of the ODV 57 of the UC nozzle 56. Flow direction is automatically switched, as OC mode changes to UC mode, to pulling cooler atmospheric air from port 77 through the diffusing chambers 55 and into now opened ODV 57 of the nozzle 56 connected to the compressor cavity 39. The cool ambient air inflow mixed with hotter cavity air after internal compression will allow the compressor to reach a much higher pressure ratio beyond its normal operating range, say from about 4/1 to about 20/1 or more. Also shown on the left side of FIG. 10*b*, the ODV 52 of the OC orifice 51 keeps closed during all under-compression conditions.

Figure 10C:
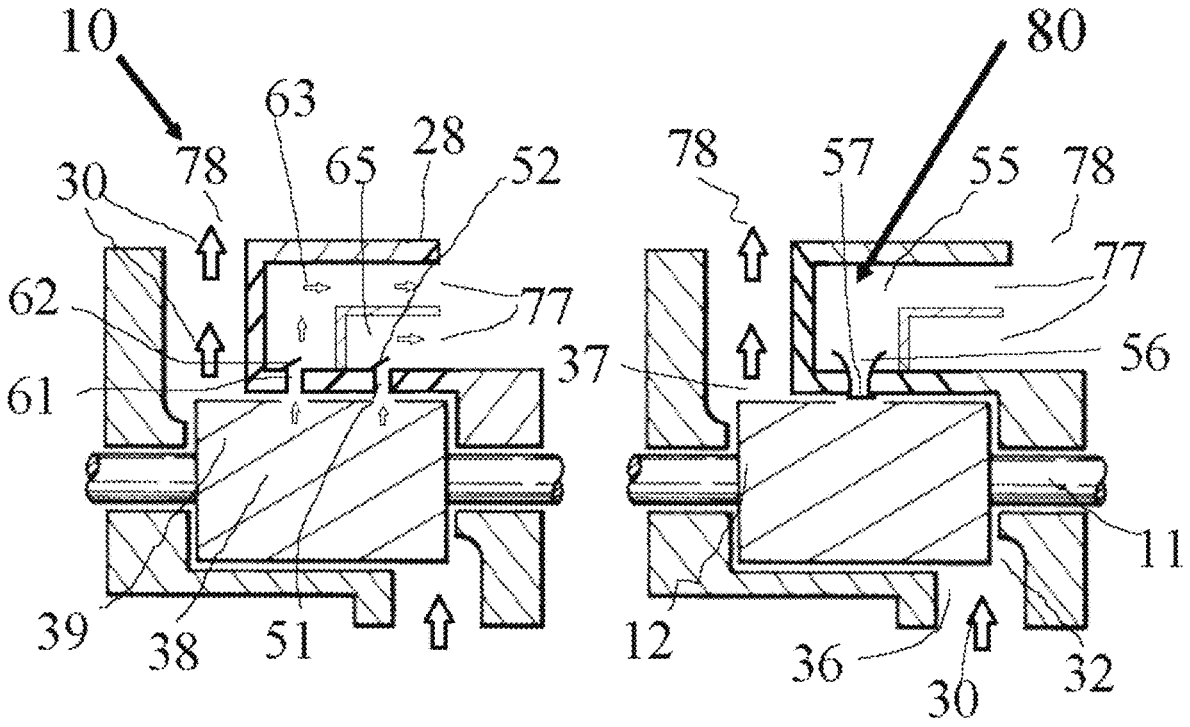
FIG. 10*c* is a cross-sectional view of a two-stage SEDAPT according to a forth example embodiment of the invention, showing the SEDAPT in a deep vacuum mode with two ODV equipped OC orifices open on left while one ODV equipped UC nozzle closed on right under an over-compression condition.
Figure 10D:
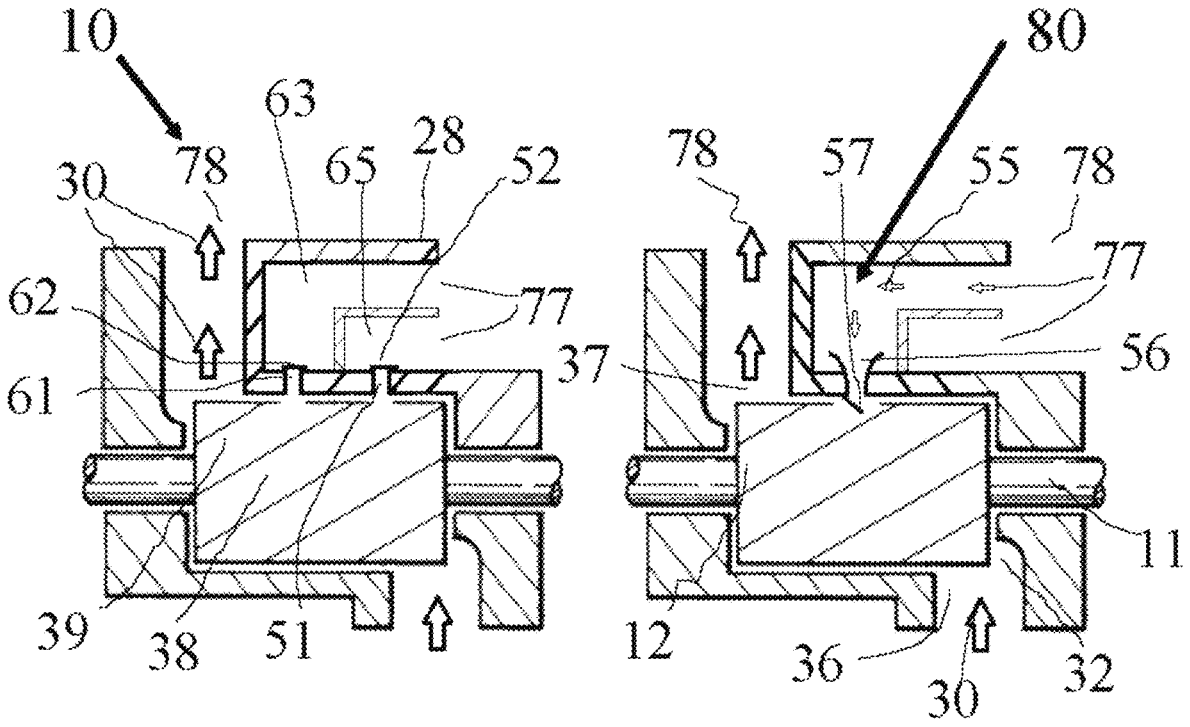
FIG. 10*d* is a cross-sectional view of a two-stage SEDAPT according to a forth example embodiment of the invention, showing the SEDAPT in a deep vacuum mode with two ODV equipped OC orifices closed on left while one ODV equipped UC nozzle open on right under an under-compression condition.

Referring to FIGS. 10*c* and 10*d*, there are shown typical arrangements of a two-stage SEDAPT with two ODV equipped OC orifices and one ODV equipped UC nozzle, according to a forth example embodiment of a screw compressor 10 with a shunt enhanced decompression and pulsation trap (SEDAPT) apparatus 80 under the OC and UC conditions, respectively. The difference of the construction of the screw compressor 10 with the SEDAPT apparatus 80 relative to that of the SEDAPT apparatus 60 of the second embodiment is that an access port or region 77 is included, instead of the feedback region 58, to connect the compressor cavities 38 & 39 directly with atmosphere 78 through the SEDAPT apparatus 80, instead of merging with the compressor outlet 37. A typical mode of operation for a two-stage SEDAPT 80 under OC condition, for example as shown on the left side of in FIG. 10*c* is the same as that shown on the left side of FIG. 10*a* for one-stage SEDAPT 70 except that two ODV equipped OC orifices are involved instead of one ODV equipped OC orifice to accommodate a wider range of the pressure ratio variation or the extent of OC. The same apply to a two-stage SEDAPT 80 under an UC condition as shown on the right side of in FIG. 10*d* with respect to the one-stage SEDAPT 70 under an UC condition as shown in FIG. 10*b*.

As such, various embodiments of the invention provide advantages over the prior art. For example, a screw compressor with a shunt enhanced decompression and pulsation trap (SEDAPT) in parallel with the compressor internal compression helps eliminate the under-compression and/or over-compression, sources of discharge gas pulsations and energy losses, when discharge port opens. A screw compressor with a shunt enhanced decompression and pulsation trap (SEDAPT) can be as effective as a slide valve variable Vi design but without mechanical moving parts and limitation to oil-injected applications. A screw compressor with a shunt enhanced decompression and pulsation trap (SEDAPT) can be an integral part of the compressor casing so that it is compact in size by eliminating the serially connected pulsation dampener at discharge. A screw compressor with a shunt enhanced decompression and pulsation trap (SEDAPT) can be capable of achieving energy savings over a wide range of pressure ratios. A screw compressor with a shunt enhanced decompression and pulsation trap (SEDAPT) can be capable of achieving reduced gas pulsations and NVH over a wide range of pressure ratios. A screw compressor with a shunt enhanced decompression and pulsation trap (SEDAPT) can be capable of achieving energy savings and higher gas pulsation attenuation over a wide range of speed and cavity passing frequency. And a screw compressor with a shunt enhanced decompression and pulsation trap (SEDAPT) can be capable of achieving the same level of adiabatic off-design efficiency as a slide valve over a wide range of pressure and speed.

It is to be understood that this invention is not limited to the specific devices, methods, conditions, or parameters of the example embodiments described and/or shown herein, and that the terminology used herein is for the purpose of describing particular embodiments by way of example only. Thus, the terminology is intended to be broadly construed and is not intended to be unnecessarily limiting of the claimed invention. For example, as used in the specification including the appended claims, the singular forms "a," "an," and "the" include the plural, the term "or" means "and/or," and reference to a particular numerical value includes at least that particular value, unless the context clearly dictates otherwise. In addition, any methods described herein are not intended to be limited to the sequence of steps described but can be carried out in other sequences, unless expressly stated otherwise herein.

While the claimed invention has been shown and described in example forms, it will be apparent to those skilled in the art that many modifications, additions, and deletions can be made therein without departing from the spirit and scope of the invention as defined by the following claims.

What is claimed is:

1. A screw compressor, comprising:

a compression chamber and a pair of meshing multi-helical-lobe rotors housed within the compression chamber and disposed on respective rotor shafts, wherein the compression chamber has a flow suction port and a flow discharge port, wherein the rotors rotate on the respective rotor shafts to cooperatively form a series of moving compression cavities inside the compression chamber for trapping and compressing fluid and propelling the trapped fluid from the flow suction port to the flow discharge port through the compression chamber during operation of the screw compressor;

a one-stage shunt-enhanced decompression and pulsation trap (SEDAPT) apparatus including a diffusing chamber and an outflow exit and the screw compressor further having an output port, the output port being positioned directly opposing the flow discharge port in a radial direction outbound from the flow discharge port, a discharge flow flowing in the radial direction from the flow discharge port to the output port and the diffusing chamber is located on one side of the compression chamber in the radial direction so that the discharge flow flows out from the compression chamber through the discharge port to the output port adjacent to and at one side of the diffusing chamber;

the diffusing chamber defining an over-compression (OC) outflow orifice having an entrance and an outflow orifice exit equipped with a one-direction valve (ODV) providing one-way fluid communication between the moving cavities inside the compression chamber and the diffusing chamber, the diffusing chamber having a feedback region providing fluid communication between the diffusing chamber and the discharge flow, wherein the SEDAPT apparatus defines a first stage of a feedback outflow loop; and the operation of the screw compressor comprising an over-compression mode and an under-compression mode, the fluid flowing out from the compression chamber and through the OC outflow orifice and through the diffusing chamber towards the discharge flow in the feedback region in the over-compression mode and no fluid flows through the OC outflow orifice into the diffusing chamber in the under-compression mode, wherein during the operation of the screw compressor the SEDAPT apparatus eliminates energy waste and reduces gas pulsations and noise, vibration, and harshness (NVH) during the over-compression mode, and lessens fluid leakage, power consumption, gas pulsations, and NVH in the under-compression mode without using a serial pulsation dampener and/or a slide valve.

2. The screw compressor as claimed in claim 1, wherein the entrance of the OC outflow orifice is arranged adjacent the pair of meshing rotors before the discharge port, the OC outflow orifice being further positioned at one of a distance about one lobe span away or is totally sealed or isolated from the flow suction port.

3. The screw compressor as claimed in claim 1, wherein the OC outflow orifice has a same cross-sectional area from the entrance to the outflow orifice exit, the same cross-sectional area comprising a different cross-sectional shape that gradually transitions from rectangular to circular from the entrance adjacent the series of moving compression cavities inside the compression chamber towards the outflow orifice exit located in the diffusing chamber.

4. The screw compressor as claimed in claim 1, wherein when the screw compressor is in the over-compression mode a pressure of the fluid contained in the compression chamber is at a first pressure and a pressure of the fluid in the diffusing chamber is at a second pressure, wherein the first pressure is greater than the second pressure causing the OC outflow orifice to open to allow fluid flow therethrough, and when the screw compressor is in the under-compression mode a third pressure of the fluid in the diffusing chamber has a greater pressure than a fourth pressure of the fluid in the compression chamber such that the OC outflow orifice is closed so that no fluid flows through the OC outflow orifice.

5. The screw compressor as claimed in claim 1, wherein the diffusing chamber defines an interior space and the ODV resides in the interior space being spaced apart from an interior surface of the diffusing chamber.

6. The screw compressor as claimed in claim 1, wherein an axial width of the entrance is greater than an axial width of the outflow orifice exit and a height of the entrance is less than a height of the outflow orifice exit.

7. The screw compressor as claimed in claim 1, wherein the diffusing chamber contains an axial end wall and the OC outflow orifice is positioned relative to the flow discharge port at a first axial distance and is positioned relative to the axial end wall at a second axial distance, the first axial distance being less than the second axial distance.

* * * * *